US007748358B2

(12) United States Patent
Tanabe et al.

(10) Patent No.: US 7,748,358 B2
(45) Date of Patent: Jul. 6, 2010

(54) VARIABLE VALVE TRAIN APPARATUS FOR INTERNAL COMBUSTION ENGINE

(75) Inventors: Mikio Tanabe, Obu (JP); Shinichi Murata, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 293 days.

(21) Appl. No.: 11/989,398

(22) PCT Filed: Jul. 25, 2006

(86) PCT No.: PCT/JP2006/314679

§ 371 (c)(1),
(2), (4) Date: Jan. 25, 2008

(87) PCT Pub. No.: WO2007/013458

PCT Pub. Date: Feb. 1, 2007

(65) Prior Publication Data

US 2009/0031972 A1 Feb. 5, 2009

(30) Foreign Application Priority Data

Jul. 25, 2005 (JP) ..... 2005-214324

(51) Int. Cl.
*F01L 1/18* (2006.01)

(52) U.S. Cl. ..... 123/90.39; 123/90.16; 123/90.44; 74/569

(58) Field of Classification Search ..... 123/90.16, 123/90.2, 90.27, 90.31, 90.39, 90.44; 74/559, 74/567, 569

See application file for complete search history.

(56) References Cited

U.S. PATENT DOCUMENTS 7,314,027 B2 * 1/2008 Murata ..... 123/90.16
2005/0274340 A1 12/2005 Murata

FOREIGN PATENT DOCUMENTS

| | | | |
|---|---|---|---|
| JP | 56-56914 | A | 5/1981 |
| JP | 2003-239712 | A | 8/2003 |
| JP | 2004-132260 | A | 4/2004 |
| JP | 2005-299536 | A | 10/2005 |
| JP | 2005-325786 | A | 11/2005 |
| JP | 2006-152926 | A | 6/2006 |

* cited by examiner

*Primary Examiner*—Ching Chang
(74) *Attorney, Agent, or Firm*—Birch, Stewart, Kolasch & Birch, LLP

(57) ABSTRACT

A variable valve train apparatus (20) has a formed on a camshaft, a rocking cam driven by the cam, an intake valve or an exhaust valve driven by the rocking cam, a control shaft provided for rotation and side by side with the camshaft, a control arm having one end held on the control shaft and the other end projecting from the control shaft, an actuator which rotates the control shaft to displace the control arm, a transmission arm connected to the other end of the control arm for rocking motion around a rocking axis in substantially the same direction as an axial direction of the control shaft and transmits a displacement of the control arm to the rocking cam, and an adjustment mechanism which adjusts a distance between an axis of the control shaft and the rocking axis of the transmission arm.

8 Claims, 14 Drawing Sheets

VARIABLE VALVE TRAIN APPARATUS FOR INTERNAL COMBUSTION ENGINE

CROSS REFERENCE

This is a U.S. national phase application under 35 USC 371 of International Application PCT/JP2006/314679 (not published in English), filed Jul. 25, 2006.

TECHNICAL FIELD

The present invention relates to a variable valve train apparatus for an internal combustion engine, in which the phase or the lift of an intake or exhaust valve is variable.

BACKGROUND ART

A reciprocating gasoline engine, which is mounted as an example of an internal combustion engine in an automobile, is mounted with a variable valve train apparatus in which the phase or the opening/closing timing of an intake valve or an exhaust valve and the lift of the valve are changed for emission control or in order to reduce fuel consumption.

The variable valve train apparatus of this type has a structure such that the characteristics of the intake valve and the exhaust valve are altered by replacing the phase of a cam formed on a camshaft with a reciprocating cam of which a base circle interval and a lift interval are continuous with each other.

Many of structures that are used to alter valve characteristics are mechanisms in which the posture of the reciprocating cam is changed based on a rocking displacement of a control shaft, and the ratio between the base circle interval and the lift interval replaced by the reciprocating cam is varied based on this change. Thus, the lift and the opening/closing timing of the intake valve or the exhaust valve are variable (see Jpn. Pat. Appln. KOKAI Publication No. 2003-239712, for example).

DISCLOSURE OF INVENTION

If an assembly error occurs in any parts of a variable valve train apparatus when the variable valve train apparatus is assembled to a cylinder head of an engine, cylinders of the engine are subject to a difference in the lift or opening/closing period, and a difference in the combustion state is inevitably caused between the cylinders. This entails generation of vibration in the engine and lowering of the fuel efficiency.

Accordingly, many variable valve train apparatuses, including the one described in Jpn. Pat. Appln. KOKAI Publication No. 2003-239712, use a structure that releases component parts themselves, such as the control shaft, of the variable valve train apparatus from support, whereby the assembly error and the like can be adjusted.

Since the above structure serves only to release the parts from support, however, high-accuracy adjustment cannot be expected of it. Thus, it is hard for this structure to make a fine adjustment to cancel the difference in the lift or opening/closing period between the cylinders.

Accordingly, the object of the present invention is to provide a variable valve train apparatus for an internal combustion engine, of which the valve lift and the opening/closing timing can be adjusted with high accuracy in wide ranges.

The present invention comprises a camshaft provided for rotation in an internal combustion engine, a cam formed on the camshaft, a rocking cam which is provided for rocking motion in the internal combustion engine and driven by the cam, an intake valve or an exhaust valve which is driven by the rocking cam, a control shaft provided for rotation and side by side with the camshaft in the internal combustion engine, a control arm having one end held on the control shaft and the other end projecting from the control shaft, an actuator which rotates the control shaft to displace the control arm, a transmission arm which is connected to the other end of the control arm for rocking motion around a rocking axis in substantially the same direction as an axial direction of the control shaft and transmits a displacement of the control arm to the rocking cam, and an adjustment mechanism which adjusts a distance between an axis of the control shaft and the rocking axis of the transmission arm.

With use of the structure for adjusting the distance between the axis of the control shaft and the rocking axis of the transmission arm, according to this arrangement, fine position adjustment along an advance direction and a delay direction can be performed for the transmission arm, so that the position of rolling contact or the position of engagement between the transmission arm and an intake cam can be adjusted finely.

In a preferred form of the invention, the control arm is configured to be held on the control shaft for rocking motion around an axis in a direction perpendicular to the axial direction of the control shaft.

According to this arrangement, the transmission arm is rockable around the axis of the control arm that projects from the control shaft. Even if a misalignment is caused by fine dislocations between the transmission arm, rocking cam, cam, etc., therefore, this misalignment is absorbed by the motion around the axis of the control arm, so that the control shaft can be free from an unnecessary burden.

In a preferred form of the invention, the one end of the control arm is inserted into the control shaft, and the adjustment mechanism is constructed including an adjustment screw member which is threadedly inserted for advance and retreat in the control shaft on the side opposite from the control arm and engages the one end of the control arm.

According to this arrangement, dispersion between cylinders and the like can be adjusted by a simple structure.

In a preferred form of the invention, the adjustment mechanism is constructed including a nut member threadedly fitted for advance and retreat on an arm portion between the control shaft and the other end of the control arm.

According to this arrangement, dispersion between cylinders and the like can be adjusted by a simple structure.

In a preferred form of the invention, the adjustment mechanism is configured so that a spacer is interposed between the one end of the control arm and the control shaft.

According to this arrangement, dispersion between cylinders and the like can be adjusted by a simple structure.

In a preferred form of the invention, the control shaft is configured to be formed with a recess in which a part of a junction portion connecting the transmission arm and the control arm is housed.

According to this arrangement, a distance between the axis of the control shaft and the junction portion between the transmission arm and the control arm can be shortened. Thus, the adjustment mechanism is compact and can be reduced in weight. Since a variation of the cam phase for each unit revolution of the control shaft is reduced, moreover, high-accuracy control characteristics can be obtained. Besides, a load with which the control arm is moved can also be reduced.

There is an additional advantage that a reaction force or rotational torque from an intake valve or an exhaust valve can be restricted to a small value.

BEST MODE FOR CARRYING OUT THE INVENTION

Figure 1:
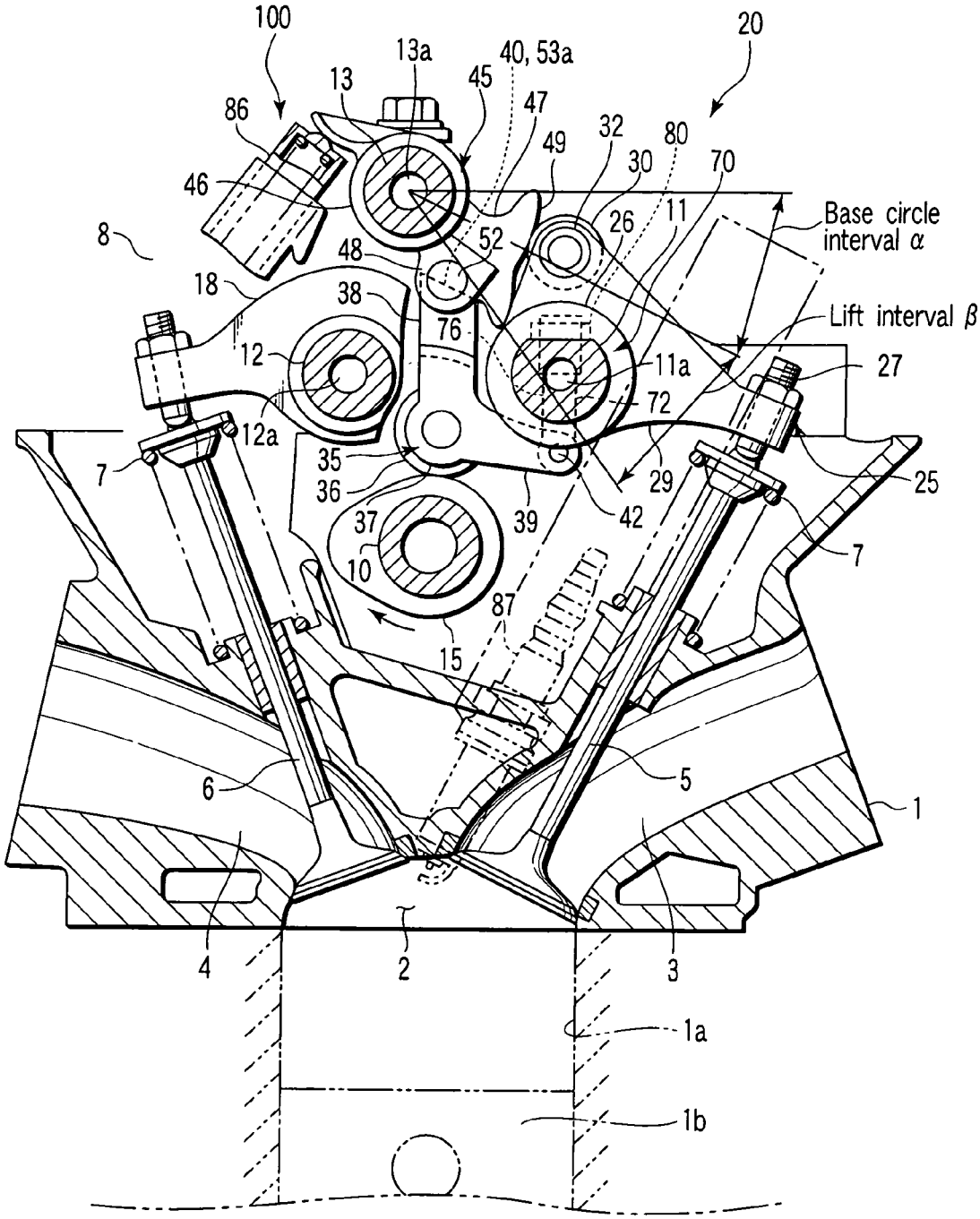
FIG. 1 is a sectional view showing a variable valve train apparatus according to a first embodiment of the present invention along with a cylinder head mounted with the apparatus.
Figure 2:
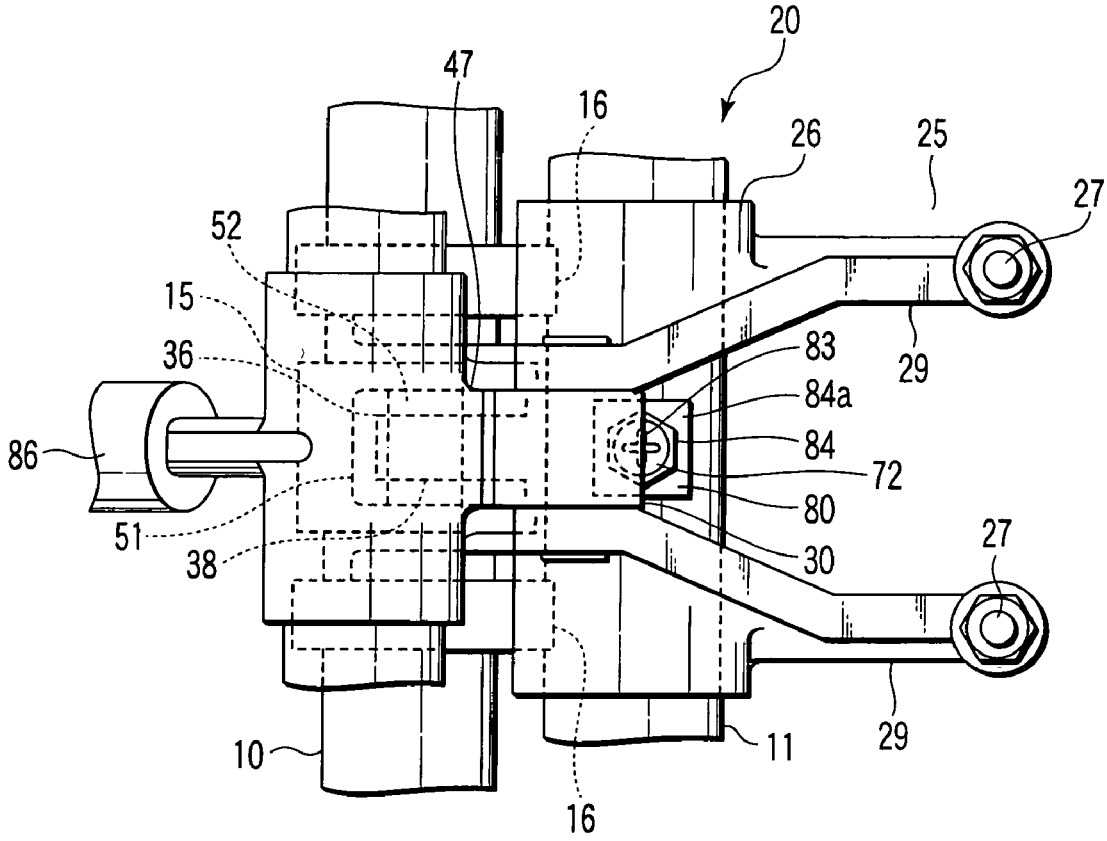
FIG. 2 is a plan view showing the variable valve train apparatus shown in FIG. 1.
Figure 3:
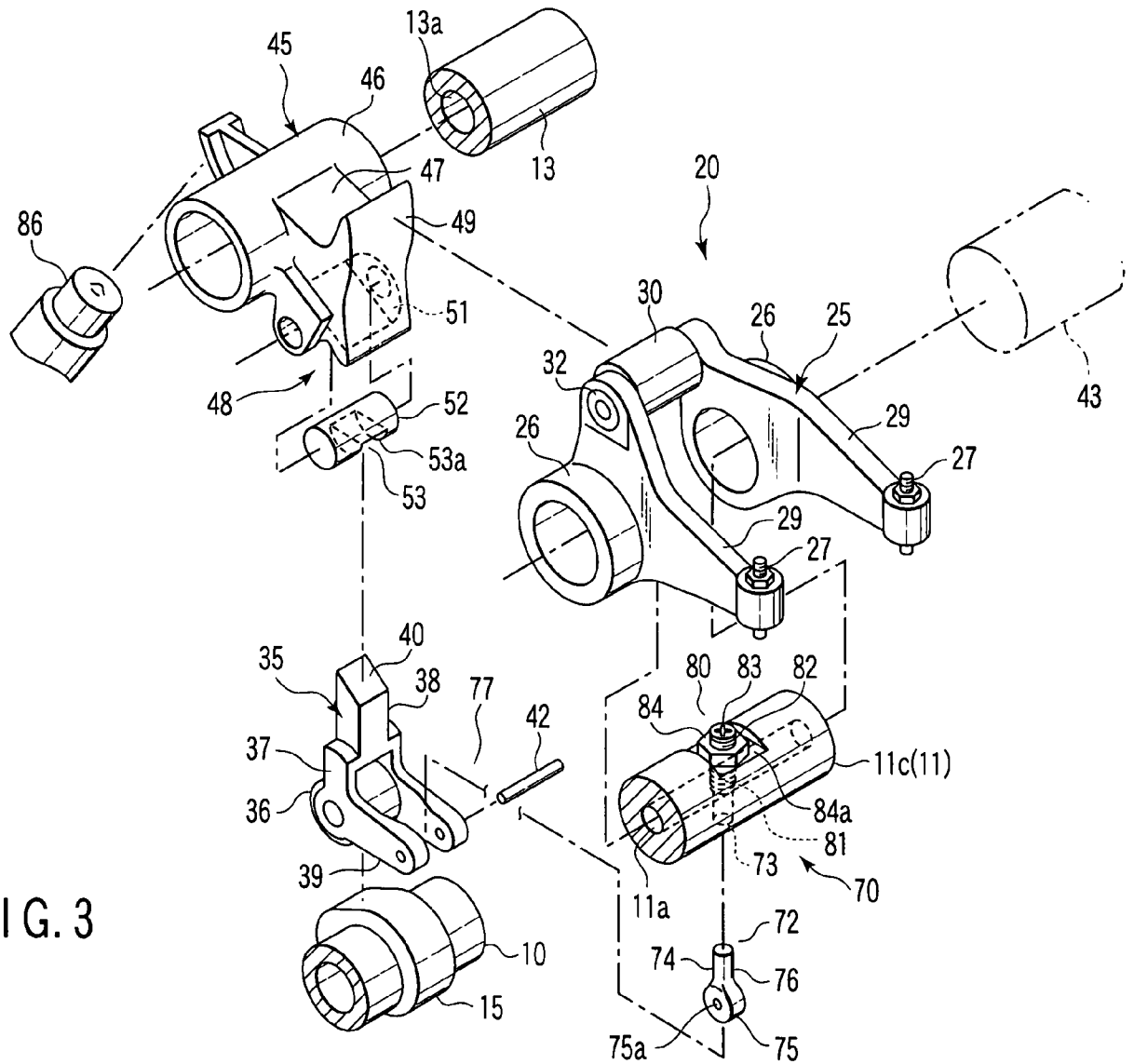
FIG. 3 is an exploded perspective view showing the variable valve train apparatus shown in FIG. 1.

A variable valve train apparatus for an internal combustion engine according to a first embodiment of the present invention will be described with reference to FIGS. 1 to 11. FIG. 1 shows a sectional view of a cylinder head 1 of the internal combustion engine, e.g., a reciprocating gasoline engine 100 in which a plurality of cylinders 1*a* are arranged in series. One of the cylinders 1*a* is shown in the drawing. FIG. 2 shows a plan view of the cylinder head 1. FIG. 3 is an exploded perspective view showing a variable valve train apparatus 20 that is mounted on the cylinder head 1.

The cylinder head 1 will be described with reference to FIGS. 1 and 2. A combustion chamber 2 is formed for each cylinder 1*a* in the lower surface of the cylinder head 1. Only one combustion chamber 2 is illustrated. For example, two or a pair of intake ports 3 and two exhaust ports 4 are assembled in each of the combustion chambers 2. Only one intake port 3 and one exhaust port 4 are illustrated.

An intake valve 5, which opens and closes the intake port 3, and an exhaust valve 6, which opens and closes the exhaust port 4, are assembled in the upper part of the cylinder head 1. The intake valve 5 and the exhaust valve 6 are normally-closed reciprocating valves, each of which is urged in a closing direction by a valve spring 7. A piston 1*b* is housed for reciprocation in the cylinder 1*a*.

On the other hand, number 8 in FIG. 1 denotes a valve train system 8 of the single overhead camshaft (SOHC) type, for example, which is mounted in the upper part of the cylinder head 1. In the SOHC-type valve train system 8, a plurality of intake valves 5 and a plurality of exhaust valves 6 are driven by one camshaft.

The following is a description of the valve train system 8. Number 10 denotes a hollow camshaft that extends along the longitudinal direction of the cylinder head 1 and is disposed for rotation over the combustion chamber 2. Number 11 denotes an intake-side rocker shaft that is rockably disposed on one side of the camshaft 10. The rocker shaft 11 doubles as a control shaft according to the present invention.

Number 12 denotes an exhaust-side rocker shaft that is fixedly disposed on the side opposite from the rocker shaft 11. Number 13 denotes a support shaft that is located, for example, over a region between the rocker shaft 11 and the rocker shaft 12 and nearer to the rocker shaft 12.

The rocker shafts 11 and 12 and the support shaft 13 are all composed of hollow shaft members that are arranged parallel to the cam shaft 10 and side by side one another. Respective bores of the shaft members serve as passages through which a lubricant circulates. Number 11*a* denotes a passage formed in the rocker shaft 11. Number 12*a* denotes a passage formed in the rocker shaft 12. Number 13*a* denotes a passage formed in the support shaft 13.

The camshaft 10 is driven for rotation in the direction of an arrow in FIG. 1 by an engine output transmitted from a crankshaft (not shown). As shown in FIG. 2, the camshaft 10 is formed with one intake cam 15 and two exhaust cams 16 for each combustion chamber 2. The intake cam 15 is equivalent to a cam according to the present invention.

The intake cam 15 is located in the center of a region over the combustion chamber 2. The exhaust cams 16, 16 are arranged individually on the opposite sides of the intake cam 15.

As shown in FIG. 1, the exhaust-side rocker shaft 12 supports an exhaust cam rocker arm 18 for each exhaust cam 16, that is, for each exhaust valve 6, for rocking motion. Only the rocker arm 18 on one side is shown in the drawing. Further, the intake-side rocker shaft 11 incorporates a variable valve train apparatus 20 for each intake cam 15, that is, for each of the intake valves 5, 5. The rocker arm 18 is a part that transmits a displacement of the exhaust cam 16 to the exhaust valve 6. The variable valve train apparatus 20 is an apparatus that transmits a displacement of the intake cam 15 to the intake valves 5, 5.

As the rocker arm 18 and the variable valve train apparatus 20 are driven by the cams 15 and 16, predetermined combustion cycles are formed in the cylinder 1*a* in association with the reciprocation of the piston 1*b*. The predetermined cycles are four cycles including, for example, an intake stroke, compression stroke, explosion stroke, and exhaust stroke.

The following is a description of the variable valve train apparatus 20. As shown in FIGS. 1 to 3, the variable valve train apparatus 20 includes a rocker arm 25 rockably supported on the rocker shaft 11, a swing cam 45 configured to engage the rocker arm 25, a center rocker arm 35 that transmits the displacement of the intake cam 15 to the swing cam 45, and a valve characteristic changing mechanism 70 that moves the center rocker arm 35 in the rotation direction of the intake cam 15. The rocker arm 25, which serves for the intake valve, is equivalent to a rocker arm according to the present invention. The swing cam 45 is equivalent to a rocking cam according to the present invention. The center rocker arm 35 is equivalent to a transmission arm according to the present invention.

As shown in FIGS. 2 and 3, for example, a bifurcated structure is used for the rocker arm 25. Specifically, the rocker arm 25 is provided with a pair of rocker arm pieces 29 and a roller member 30.

Each rocker arm piece 29 is formed having a cylindrical rocker arm supporting boss 26 in its center, and a driving portion, e.g., an adjustment screw portion 27, for driving the intake valve 5 is coupled to one end side of the rocker arm piece. The roller member 30 is sandwiched between the respective other end portions of the rocker arm pieces 29 and is rotatable. The roller member 30 forms a contact portion according to the present invention. Number 32 denotes a short shaft that pivotally supports the roller member 30 for rotation on the rocker arm pieces 29.

The rocker shaft 11 is rockably fitted in the rocker arm supporting bosses 26. The roller member 30 is located on the support shaft 13 side, that is, on the center side of the cylinder head 1. The adjustment screw portions 27 are located individually on the respective upper ends or valve stem ends of the intake valves 5, 5. When the rocker arm 25 rocks around the rocker shaft 11, therefore, the intake valves 5, 5 are driven.

As shown in FIGS. 1 to 3, the swing cam 45 includes a boss portion 46, an arm portion 47, and a receiving portion 48. The boss portion 46 is in the form of a cylinder that is rockably fitted on the support shaft 13. The arm portion 47 extends from the boss portion 46 toward the roller member 30 or the rocker arm 25. The receiving portion 48 is formed on the lower part of the arm portion 47.

The distal end surface of the arm portion 47 is formed having a cam surface 49, which extends, for example, in the vertical direction and serves as a transmission surface portion that transmits a displacement to the rocker arm 25. The cam surface 49 is in rolling contact with the outer peripheral surface of the roller member 30 of the rocker arm 25. The cam surface 49 will be described in detail later.

As shown in FIG. 3, the receiving portion 48 has a structure provided with a depression 51, which is formed, for example, in that lower surface portion of the lower part of the arm portion 47 which is situated right over the camshaft 10, and a short shaft 52 supported in the depression 51 for rotation in the same direction as the camshaft 10. Number 53 denotes a recess with a flat bottom surface formed in the outer peripheral portion of that part of the short shaft 52 which is exposed in the depression 51.

As shown in FIGS. 1 and 3, the center rocker arm 35 is a substantially L-shaped member that includes a roller, e.g., a cam follower 36, in rolling contact with a cam surface of the intake cam 15 and a frame-shaped holder portion 37 that supports the cam follower 36 for rotation.

Specifically, the center rocker arm 35 is an L-shaped structure including a relay arm portion 38 and a fulcrum arm portion 39.

The relay arm portion 38 is in the form of a pillar that extends from the holder portion 37 around the cam follower 36 toward an overlying region between the rocker shaft 11 and the support shaft 13. The fulcrum arm portion 39 extends from side portions of the holder portion 37 toward the underside of a shaft portion 11*c* of the rocker shaft 11 that is exposed from between the pair of rocker arm pieces 29. The shaft portion 11*c* is shown in FIGS. 6 to 9.

For example, the fulcrum arm portion 39 is bifurcated. Further, a slope 40 as a driving surface is formed on the distal end or upper end surface of the relay arm portion 38. The slope 40 is inclined so as to be lower on the rocker shaft 11 side and higher on the support shaft 13 side.

The distal end of the relay arm portion 38 is inserted into the recess 53 of the swing cam 45. As this is done, the center rocker arm 35 is interposed between the intake cam 15 and the swing cam 45. The slope 40 of the relay arm portion 38 is caused to slidably abut a receiving surface 53*a* that is formed on the bottom surface of the recess 53. Thus, slippage occurs as the displacement of the intake cam 15 is transmitted from the relay arm portion 38 to the swing cam 45.

As shown in FIGS. 1 and 3, the valve characteristic changing mechanism 70 includes an arm moving mechanism 77 and an adjustment portion 80. The arm moving mechanism 77 uses a control arm 72 that is inserted into the shaft portion 11*c* in the diametrical direction at right angles to its axis, whereby the center rocker arm 35 is made movable.

The adjustment portion 80 adjusts the distance between the axis of the shaft portion 11*c* and the distal end of the control arm 72, that is, the amount of projection of the control arm 72 from the shaft portion 11*c*. The adjustment portion 80 is equivalent to an adjustment mechanism according to the present invention.

Figure 4A:
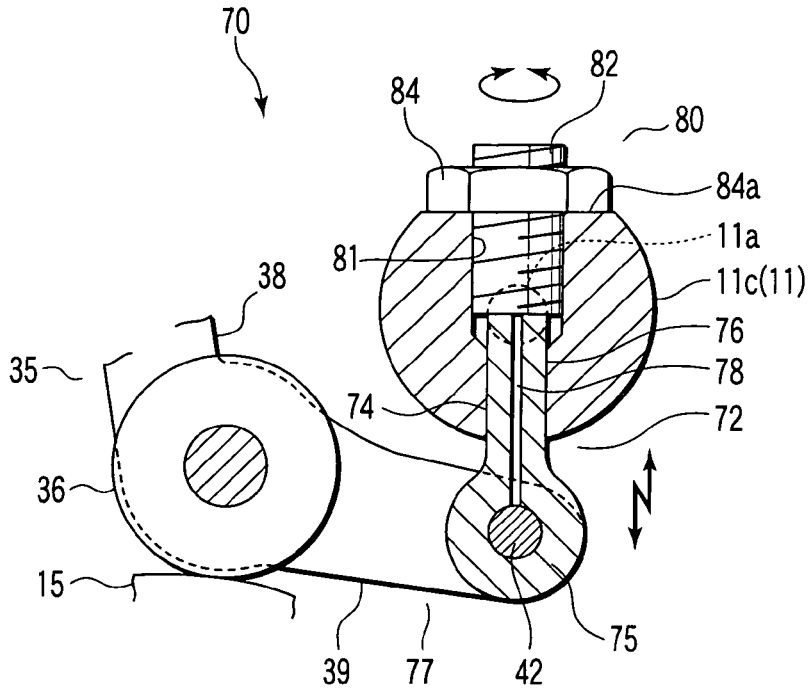
FIG. 4A is a front view, partially in section, showing the structure of an adjustment portion for adjusting dispersion of the variable valve train apparatus shown in FIG. 1.
Figure 4B:
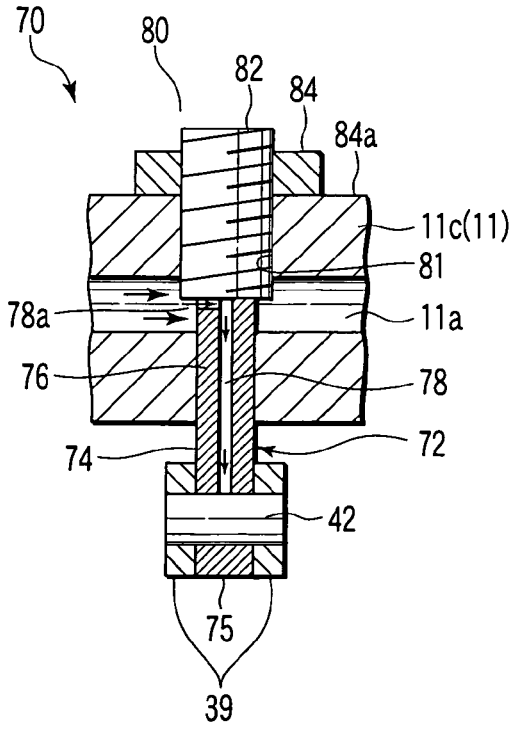
FIG. 4B is a sectional side view, partially in section, showing the structure of the adjustment portion for adjusting dispersion of the variable valve train apparatus shown in FIG. 1.
Figure 5:
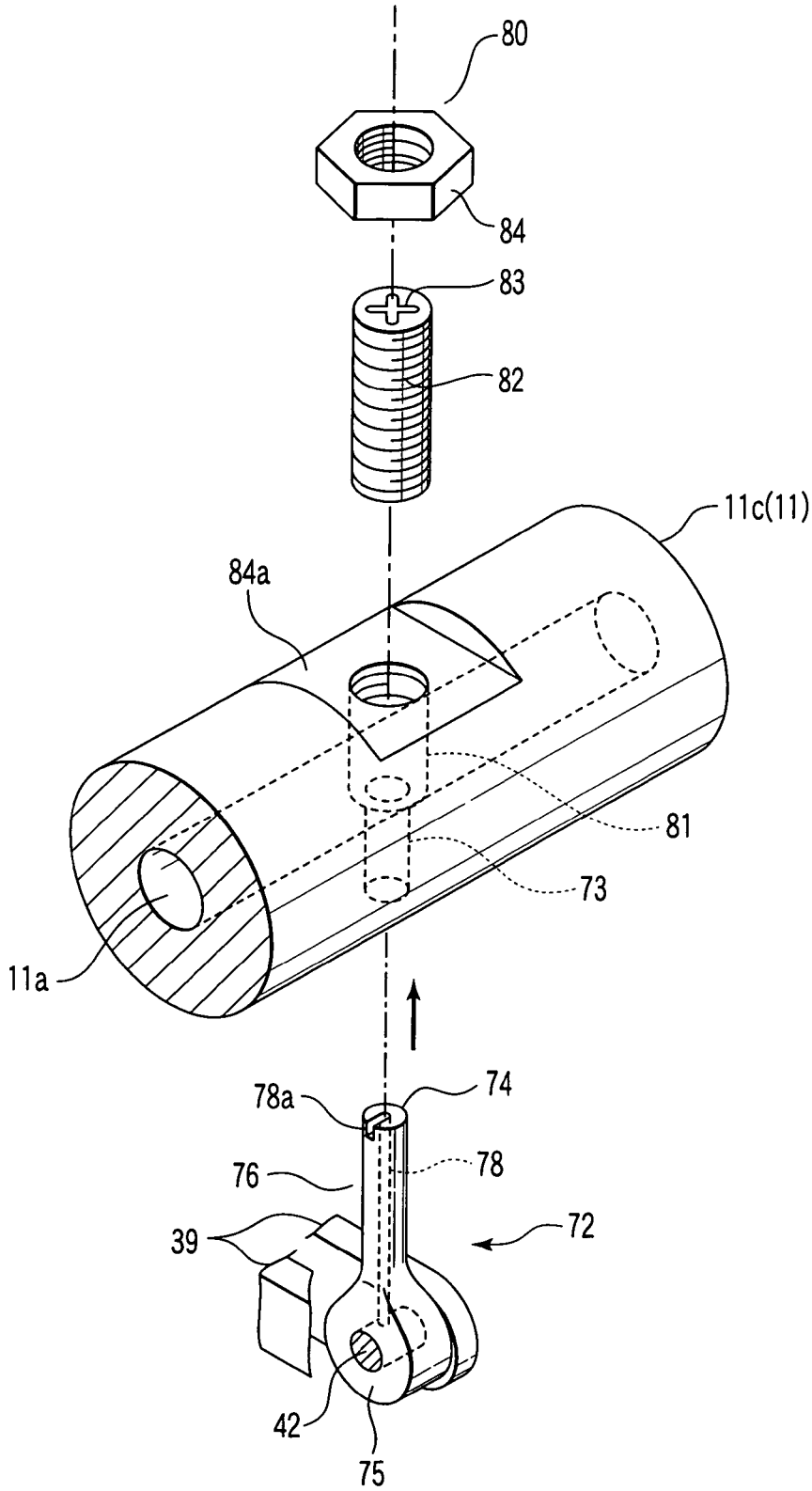
FIG. 5 is an exploded perspective view showing various parts of the adjustment portion shown in FIGS. 4A and 4B.

FIGS. 3 to 5 show specific structures of the arm moving mechanism 77 and the adjustment portion 80. The arm moving mechanism 77 will be described with reference to these drawings. As shown in FIG. 5, a lower peripheral wall of the shaft portion 11*c* is formed with a through hole 73 that extends at right angles to the axis of the shaft portion 11*c*. The through hole 73 is a hole that communicates with the passage 11*a*.

The control arm 72 includes a shaft portion 74 having a circular cross section, a flange-shaped pin connecting piece 75 formed on one end of the shaft portion 74, and a support hole 75*a* formed in the pin connecting piece 75 shown in FIG. 3.

A lubricant passage 78 is formed in the control arm 72 so as to cover its overall length or, more specifically, a range from the support hole 75*a* to the opposite end. As shown in FIGS. 4A and 4B, moreover, a notch portion 78*a* for defining an inlet of the lubricant passage 78 is formed at the other end of the shaft portion 74. The outside diameter of the whole body of the shaft portion 74 except the pin connecting piece 75 is set so that the shaft portion can be inserted into the through hole 73. That part of the control arm 72 which extends from the pin connecting piece 75 to the opposite end thereof is defined as an adjustment area portion 76. The adjustment area portion 76 is inserted into the through hole 73 from under the shaft portion 11*c*. The inserted adjustment area portion 76 is movable with respect to the axial direction and the circumferential direction. The adjustment area portion 76 is supported by the adjustment portion 80, which will be mentioned later.

The pin connecting piece 75 is inserted into the bifurcated fulcrum arm portion 39 and connected to the distal end portion of the fulcrum arm portion 39, for rocking motion in a direction perpendicular to the respective axes of the camshaft 10 and the rocker shaft 11, by a pin 42 that penetrates the arm portion 39 and the support hole 75*a*.

As the intake cam 15 rotates, based on this connection, the relay arm portion 38 of the center rocker arm 35 is displaced or rocked in the vertical direction around the pin 42. In association with the motion of the center rocker arm 35, moreover, the swing cam 45 periodically rocks around the support shaft 13 as a fulcrum, based on the short shaft 52 as a load point on which a load from the center rocker arm 35 acts and the cam surface 49 as an effort point at which the rocker arm 25 is driven.

As shown in FIG. 3, a control actuator, e.g., a control motor 43, is connected to an end portion of the rocker shaft 11. The control motor 43 rocks the rocker shaft 11. When the rocker shaft 11 rocks, the control arm 72 moves from a posture in which it is located substantially in the vertical direction shown in FIGS. 6 and 7, for example, to a posture in which it is sharply inclined in the rotation direction of the rocker shaft 11 shown in FIGS. 8 and 9.

Specifically, the center rocker arm 35 can be moved or displaced across the axial direction of the shaft portion 11*c* as the control arm 72 moves. Thereupon, a position of rolling contact or position of engagement of the cam follower 36 with the intake cam 15 is moved or shifted in an advance direction or a delay direction, as shown in FIGS. 6 to 9.

The posture of the cam surface 49 of the swing cam 45 can be changed by shifting the position of rolling contact. As the posture of the cam surface 49 of the swing cam 45 is changed, the opening/closing timing and the valve lift of the intake valve 5 can be altered simultaneously.

In connection with this, the cam surface 49 is a curved surface of which, for example, the distance from the center of the support shaft 13 varies. As shown in FIG. 1, for example, the upper side of the cam surface 49 is a base circle interval $\alpha$, that is, an interval defined by a circular-arc surface around the axis of the support shaft 13. The lower side of the cam surface 49 is a lift interval $\beta$, that is, an interval defined by a plurality of circular-arc surfaces continuous with the aforesaid circular arc or, more specifically, circular-arc surfaces similar to those of the cam shape of a lift area of the intake cam 15, for example.

If the cam follower 36 is displaced in the advance direction or the delay direction of the intake cam 15 by the cam surface 49, the posture of the swing cam 45 changes. As the posture of the swing cam 45 changes, the region in which the roller member 30 is in contact with the cam surface 49 changes. More specifically, the phase of the intake cam 15 shifts in the advance direction or the delay direction as the ratio between the base circle interval $\alpha$ and the lift interval $\beta$ in which the roller member 30 travels changes.

With the change of the ratio between the intervals $\alpha$ and $\beta$ that involves the phase change in the advance direction or the phase change in the delay direction, the opening/closing timing of the intake valve 5 is set so that the valve closing timing is changed more greatly than the valve opening timing, and at the same time, the valve lift of the intake valve 5 is changed continuously.

As shown in FIGS. 3 to 5, the adjustment portion 80 has a structure that includes a threaded hole 81, which is formed in that part of the shaft portion 11*c* on the side opposite from the through hole 73, that is, an upper peripheral wall of the shaft portion 11*c*, and a shaft-shaped screw member 82 that is threadedly inserted into the threaded hole 81 for advance and retreat. The threaded hole 81 is shown in FIG. 4. The screw member 82 is equivalent to an adjustment screw member according to the present invention.

The threaded hole 81 extends up to the passage 11*a* of the shaft portion 11*c*. The threaded hole 81 is located in series with the through hole 73 with the passage 11*a* between them. The end of the control arm 72 that is inserted into the through hole 73 abuts an end of the screw member 82 that is screwed in the threaded hole 81. As this is done, an end of the fulcrum arm portion 39 of the center rocker arm 35 is positioned.

The abutment between the end of the control arm 72 and the screw member 82 is confined within the passage 11*a*. Based on this setting, the lubricant (not shown) in the passage 11*a* is supplied through the lubricant passage 78 to regions which require lubrication, such as a sliding portion of the pin 42.

In order to secure high support stiffness, according to the present embodiment, dimensions larger than the respective outside diameters of the through hole 73 and the adjustment area portion 76 are used for the threaded hole 81 and the screw member 82. However, any dimensions may be used as long as the stiffness can be secured.

Since the control arm 72 is supported in the aforesaid manner, the amount of projection of the adjustment area portion 76 or the control arm 72 from the shaft portion 11*c* can be adjusted by operating the screw member 82 for rotation.

Number 83 denotes, for example, a cruciform groove portion that is formed in the upper end surface of the screw member 82, that is, an end surface that is exposed from the shaft portion 11*c*, and serves for the rotational operation of the screw member 82. Number 84 denotes a locknut that is screwed onto the screw member 82 to lock it. Number 84*a* denotes a notch that defines a bearing surface of the locknut 84.

Since the amount of projection of the control arm 72 is variable, the position of rolling contact between the intake cam 15 and the center rocker arm 35 can be shifted to change the posture of the center rocker arm 35 and the posture of the swing cam 45, thereby adjusting the opening/closing timing and the valve lift of the intake valve 5.

In FIGS. 1 to 3, number 86 denotes a pusher that urges the intake cam 15, center rocker arm 35, and swing cam 45 to come into close contact with one another. Number 87 denotes a spark plug for lighting a fuel-air mixture in the combustion chamber 2.

The following is a description of the operation of the variable valve train apparatus 20 constructed in this manner.

Let it be supposed that the camshaft 10 is being rotated in the direction of the arrow in FIG. 1 by the operation of the engine.

Since the cam follower 36 of the center rocker arm 35 is then in rolling contact with the intake cam 15, it is driven following the cam profile of the intake cam 15. Thus, the center rocker arm 35 rocks in the vertical direction around the pin 42.

On the other hand, a rocking displacement of the center rocker arm 35 is transmitted to the receiving surface 53*a* of the swing cam 45 via the slope 40 of the relay arm portion 38. Since the receiving surface 53*a* and the slope 40 are slidable, the swing cam 45 slides on the slope 40 as it repeats rocking motion such that it is pushed up or lowered by the slope 40. As the swing cam 45 rocks, the cam surface 49 is driven to reciprocate in the vertical direction.

When this is done, the cam surface 49 is in rolling contact with the roller member 30, so that the roller member 30 is periodically pressed by the cam surface 49. Pressed in this manner, the rocker arm 25 is driven or rocked around the rocker shaft 11, thereby opening or closing the plurality of or the pair of intake valves 5.

Figure 6:
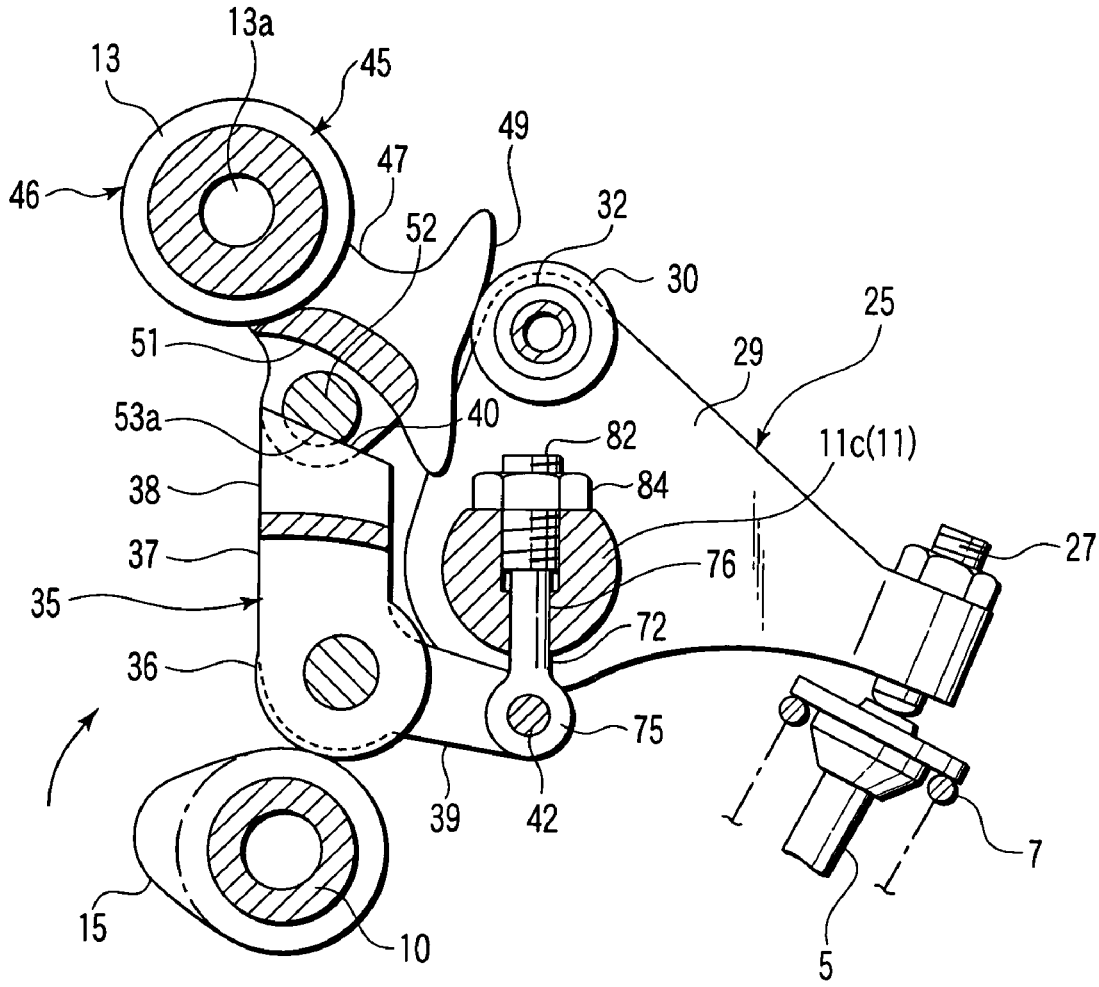
FIG. 6 is a sectional view showing a state in which a rocker arm is in contact with a base circle interval of a cam surface during maximum valve lift control of the variable valve train apparatus shown in FIG. 1.
Figure 7:
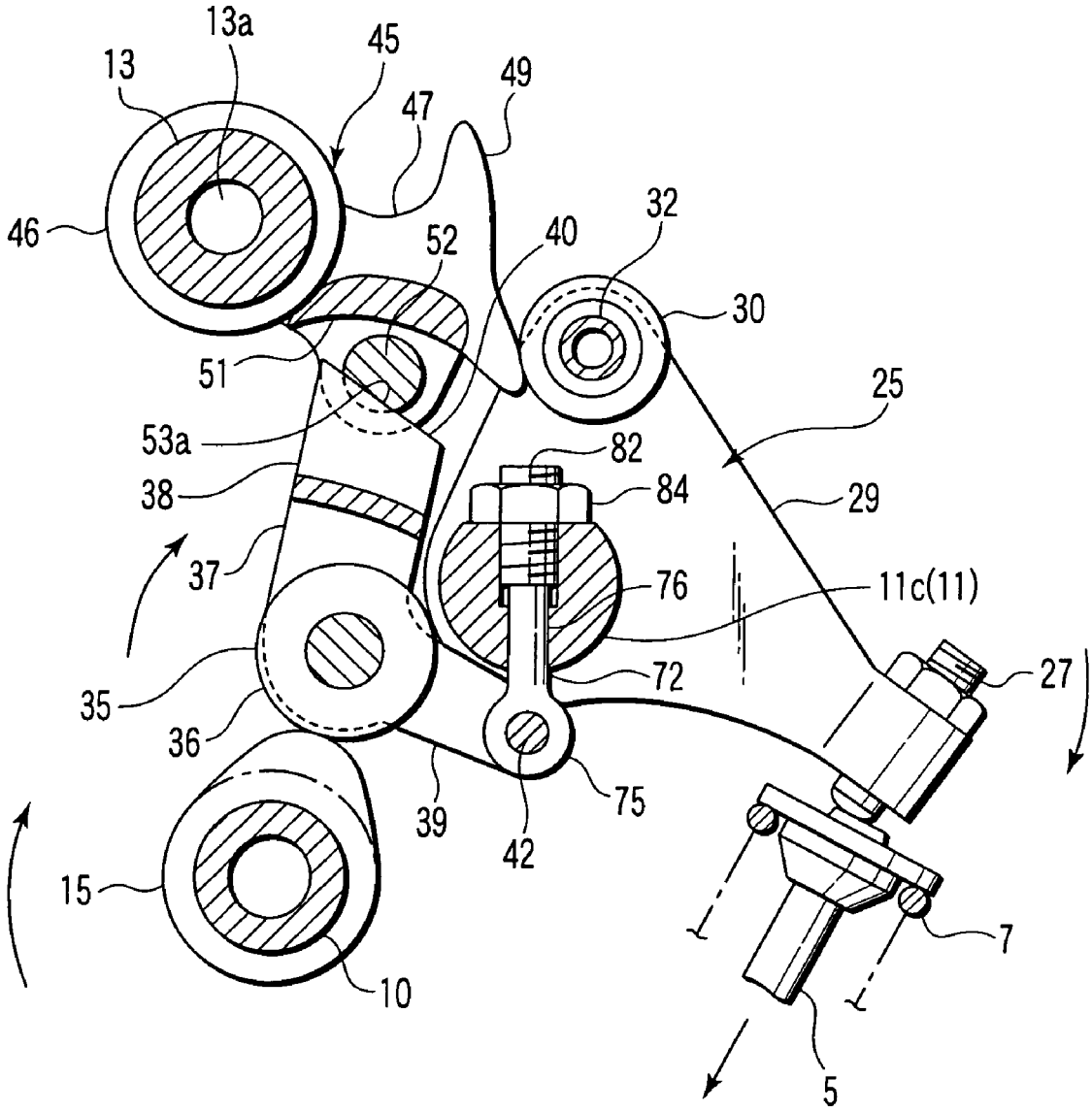
FIG. 7 is a sectional view showing a state in which the rocker arm is in contact with a lift interval of the cam surface during the maximum valve lift control of the variable valve train apparatus shown in FIG. 1.

As this is done, the rocker shaft 11 is rocked by the operation of the control motor 43, whereby the control arm 72 is rocked to, for example, a spot where a maximum valve lift is secured, e.g., a spot where a vertical posture shown in FIGS. 6 and 7 is obtained.

Based on this rocking displacement of the control arm 72, the center rocker arm 35 then moves along the rotation direction on the intake cam 15. Thus, the position of rolling contact between the center rocker arm 35 and the intake cam 15 shifts along the delay direction on the intake cam 15, as shown in FIGS. 6 and 7. In consequence, the cam surface 49 of the swing cam 45 is positioned in a substantially upright posture.

Based on this posture of the cam surface 49, as shown in FIGS. 6 and 7, the ratio between the base circle interval $\alpha$ and the lift interval $\beta$, that is, the regions where the roller member 30 travels on the cam surface 49, is set for the regions where the maximum valve lift is obtained, that is, the shortest base circle interval $\alpha$ and the longest lift interval $\beta$.

Thus, the rocker arm 25 is driven by a cam surface portion that is defined by the narrow base circle interval $\alpha$ and the longest lift interval $\beta$. In consequence, the intake valve 5 is opened or closed with an opening/closing timing based on a maximum valve lift indicated by the diagram A1 in FIG. 11, for example, and a top position of an intake valve lift curve.

Figure 8:
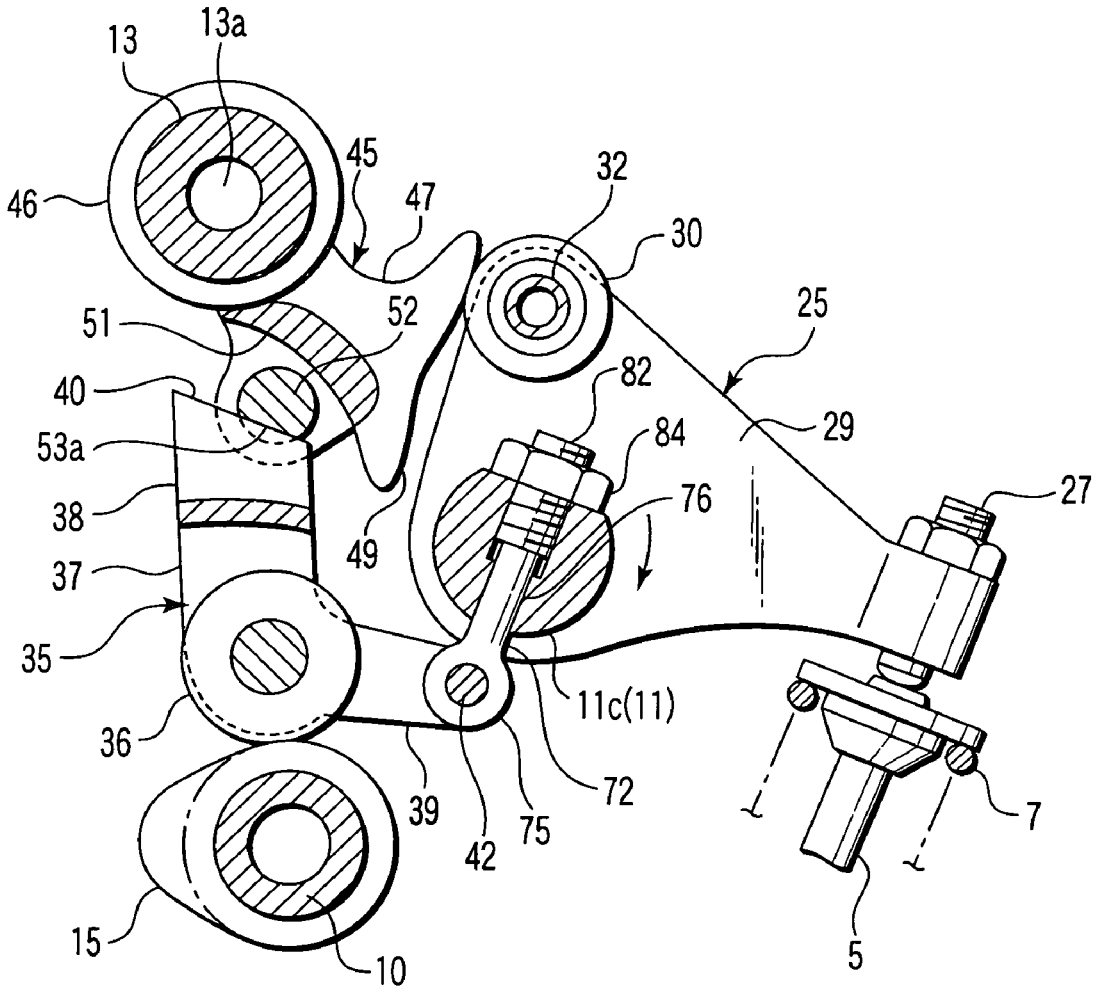
FIG. 8 is a sectional view showing a state in which the rocker arm is in contact with the base circle interval of the cam surface during minimum valve lift control of the variable valve train apparatus shown in FIG. 1.
Figure 9:
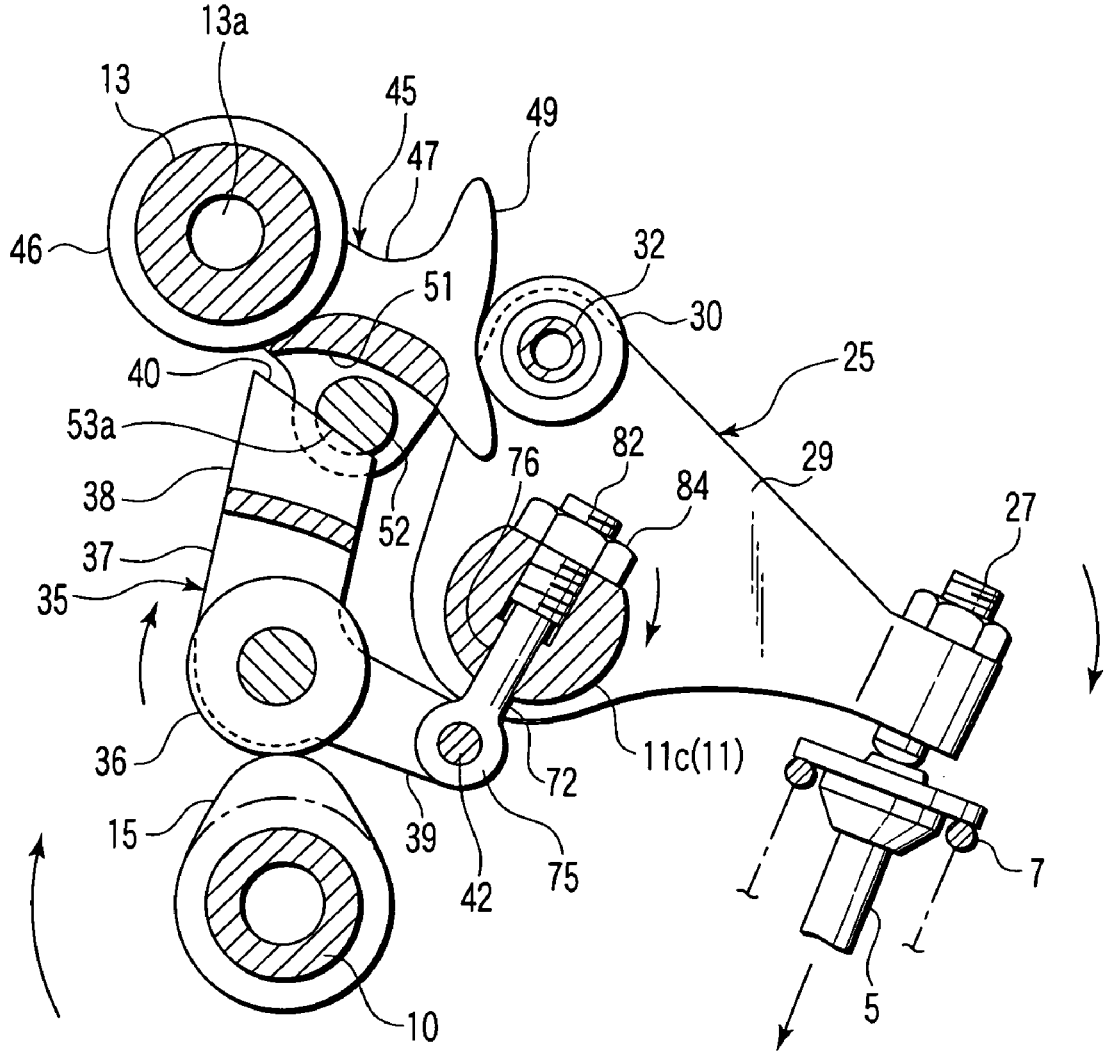
FIG. 9 is a sectional view showing a state in which the rocker arm is in contact with the lift interval of the cam surface during the minimum valve lift control of the variable valve train apparatus shown in FIG. 1.

In decreasingly changing from this state the lift of the intake valve 5 and the range of the intake cam 15 in which the intake valve 5 is opened, moreover, the rocker shaft 11 is rocked by the operation of the control motor 43, whereby the control arm 72 is inclined in a direction such that the pin 42 approaches the intake cam 15, as shown in FIGS. 8 and 9.

Based on the rocking displacement of the control arm 72, the center rocker arm 35 then moves forward in the rotation direction on the intake cam 15. Thus, the position of rolling contact or the position of engagement between the center rocker arm 35 and the intake cam 15 shifts in the advance direction on the intake cam 15, as shown in FIGS. 8 and 9. This shift of the rolling contact position hastens the valve opening timing of the cam phase. As the center rocker arm 35 moves, moreover, the slope 40 also slides in the cam advance direction from its initial position on the receiving surface 53*a*.

When the center rocker arm 35 moves in this manner, the posture of the swing cam 45 changes into a posture such that the cam surface 49 is inclined downward, as shown in FIGS. 8 and 9.

The ratio of a region of the cam surface 49 in which the roller member 30 travels changes so that the base circle interval $\alpha$ gradually lengthens and the lift interval $\beta$ gradually shorten, that is, the cam profile of the cam surface 49 is changed.

When the changed cam profile of the cam surface 49 is transmitted to the roller member 30, therefore, the rocker arm 25 is driven to rock in a manner such that the top position of the intake valve lift curve is advanced in the cam advance direction.

Figure 11:
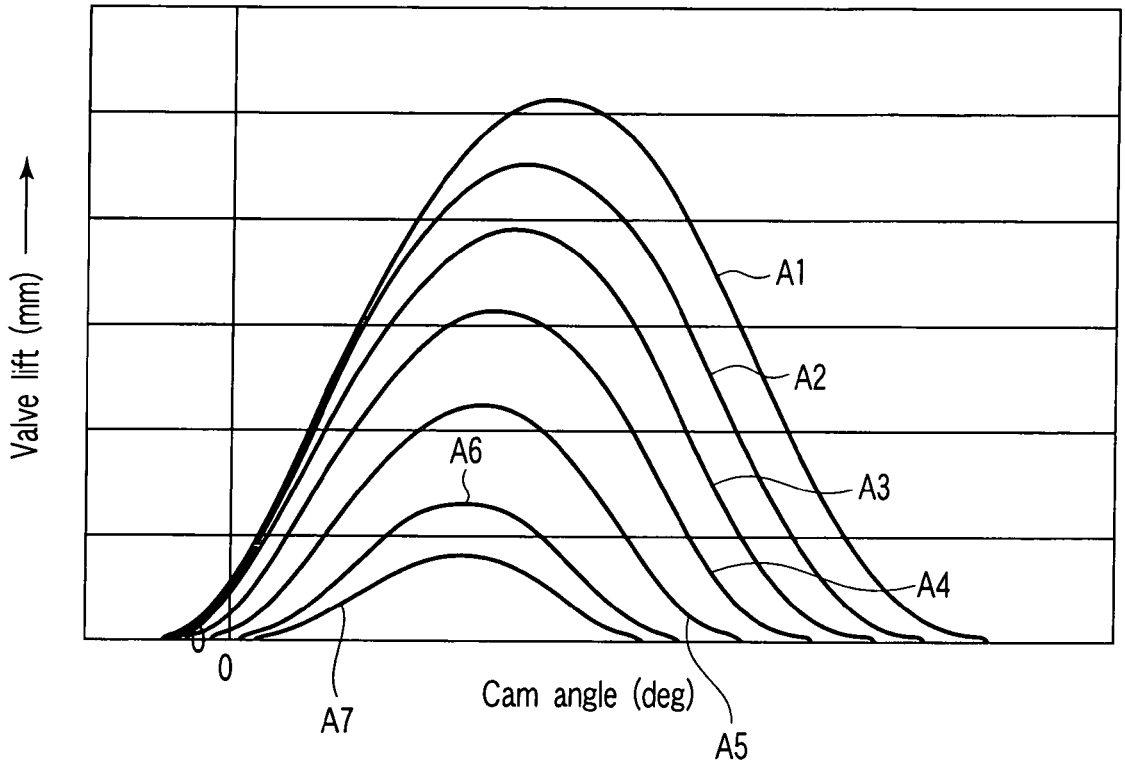
FIG. 11 is a diagram showing the performance of the variable valve train apparatus shown in FIG. 1.

Thus, the intake valve 5 is controlled by continuous simultaneous variations of the opening/closing timing and the valve lift such that the valve closing timing is greatly changed without substantially changing the valve opening timing or without failing to maintain the timing for valve opening, as shown in FIG. 11 illustrating valve lifts from the maximum valve lift A1 to a minimum valve lift A7 that is obtained when a pin member 41 tilts to a maximum.

Let it be supposed that dispersions in the valve opening timing of the intake valve 5, such as assembly dispersion, dispersion between the cylinders, etc., are adjusted with the variable valve train apparatus 20 kept assembled to the cylinder head 1.

In this case, the rocker shaft 11 is first rocked when the engine is non-operating so that the rocker shaft 11 is inclined to a posture such that the head or the end portion of the screw member 82 having the groove portion 83 thereon faces the space between the rocker arm pieces 29, 29, or more specifically, a posture that facilitates operation.

Figure 10:
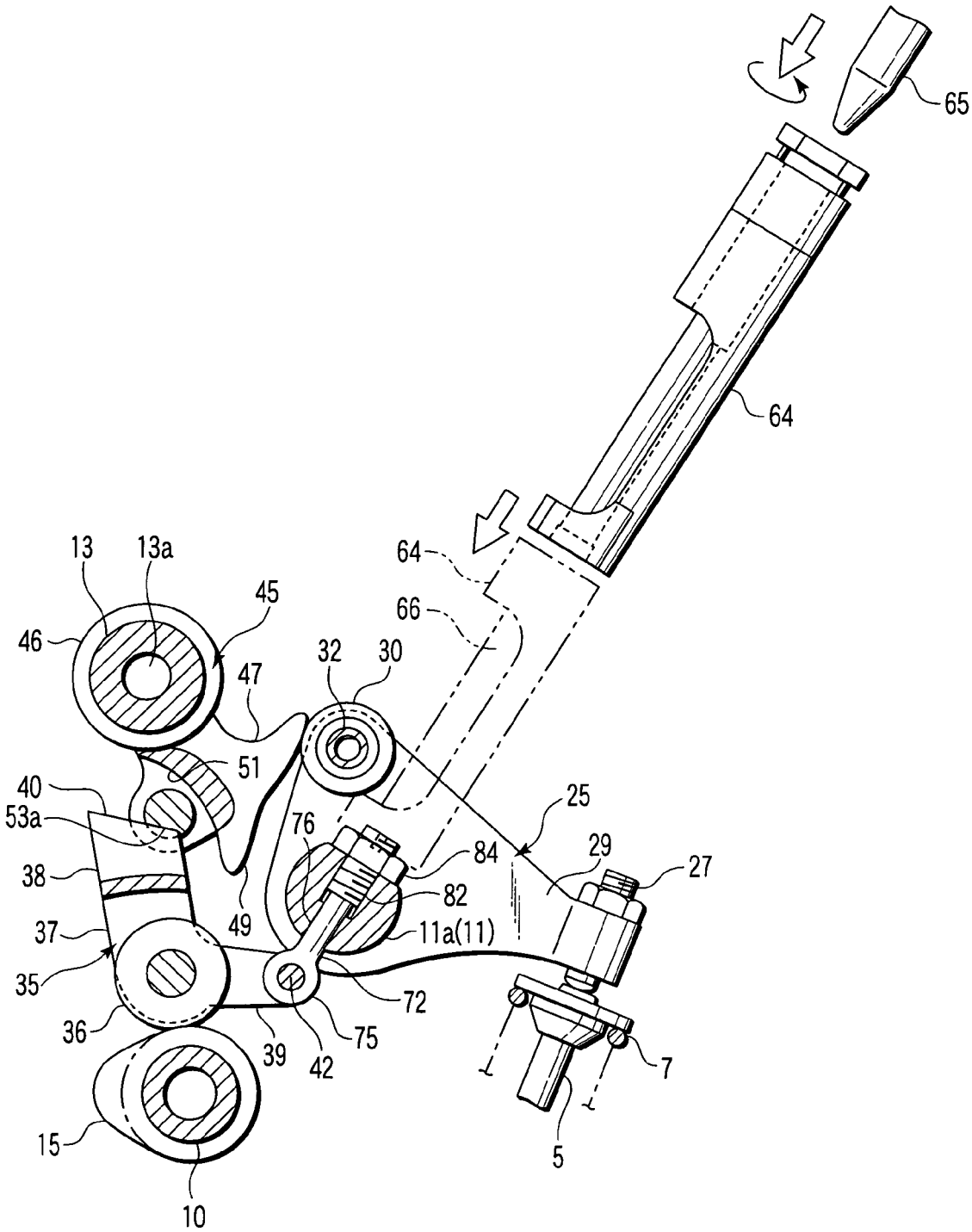
FIG. 10 is a sectional view for illustrating adjustment operation of the variable valve train apparatus shown in FIG. 1.

Then, the distal end portion of a screwdriver tool 64 is fitted onto the locknut 84 through the gap between the rocker arm pieces 29, 29, whereby a guide path 66 for the insertion of a screwdriver 65 is formed between the rear end of the screwdriver tool 64 and the end portion of the screw member 82, as indicated by two-dot chain line in FIG. 10.

Then, the distal end side of the screwdriver 65 is inserted into the guide path 66, and a cross-shaped insert portion at the screwdriver 65 is inserted into the cruciform groove portion 83 of at the end of the screw member 82.

Subsequently, the screwdriver tool 64 is turned with the screwdriver 65 fixed therein to loosen the locknut 84*b*. If the screwdriver 65 is then turned to regulate the amount of projection of the control arm 72, the posture of the center rocker arm 35 is changed. Thereupon, the position of rolling contact or the position of engagement between the center rocker arm 35 and the intake cam 15 is adjusted. The position of the swing cam 45 is changed by this adjustment. As a driving position in which the rocker arm 25 of the swing cam 45 is driven is changed, the opening/closing phase and the lift of the intake valve 5 are adjusted.

Thus, the position of rolling contact between the center rocker arm 35 and the intake cam 15 is changed by the movement of the control arm 72 that is incorporated in the rocker shaft 11. The structure for adjusting the amount of projection of the control arm 72 is adopted as a variable valve structure for changing the range of drive of the rocker arm 25. By doing this, fine position adjustment along the advance direction and the delay direction can be performed for the center rocker arm 35, so that the position of rolling contact or the position of engagement between the center rocker arm 35 and the intake cam 15 can be adjusted finely.

Accordingly, dispersion between the cylinders and the like can be adjusted with high accuracy, so that generation of vibration in the internal combustion engine and lowering of the fuel efficiency can be prevented. Besides, the center rocker arm 35 and the control arm 72 are connected by the pin 42. Therefore, a variable range for the control arm 72 is transmitted directly to the center rocker arm 35, so that the adjustment can be performed covering a wide-range region.

In addition to this, an adjustment structure for the rolling contact position should only be a simple structure such that the end of the control arm 72 is caused to abut the screw member 82 by screwing the screw member 82 into that side of the shaft portion 11*c* opposite from the control arm 72. Besides, the center rocker arm 35 is inserted into the shaft portion 11*c* so that it is rockable around the axis of the control arm 72 that extends at right angles to the axis of the rocker shaft 11. Even if a misalignment is caused such that the center rocker arm 35 and a contact surface of the intake cam 15 fail to be parallel to each other, therefore, this misalignment is absorbed by the motion of the control arm 72. Accordingly, the cam surface and the cam follower 36 of the center rocker arm 35 cannot easily be subjected to a burden, such as a local load bias.

Further, the direction of adjustment of the control arm 72, that is, the direction of movement of the control arm 72 by the adjustment mechanism, is not aligned with the direction of movement of the center rocker arm 35 caused by valve characteristic change. Therefore, the amount of adjustment of the control arm 72 by the adjustment mechanism cannot be reflected directly in the direction of movement of the center rocker arm 35 by the valve characteristic change. Thus, the adjustment amount can be relatively large, so that the adjustment accuracy is improved.

Figure 12A:
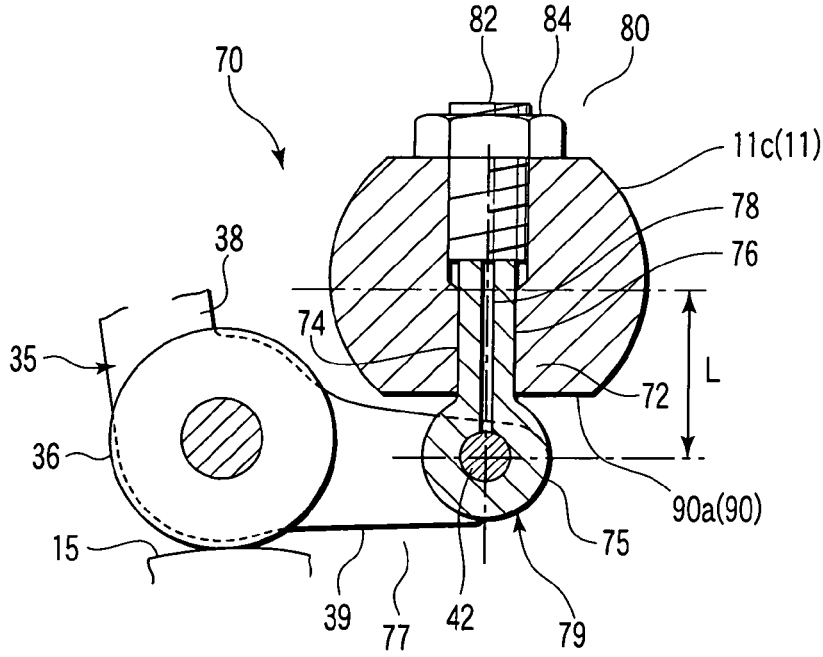
FIG. 12A is a front view, partially in section, showing principal parts of a variable valve train apparatus according to a second embodiment of the present invention and the structure of an adjustment portion for adjusting dispersion of the variable valve train apparatus.
Figure 12B:
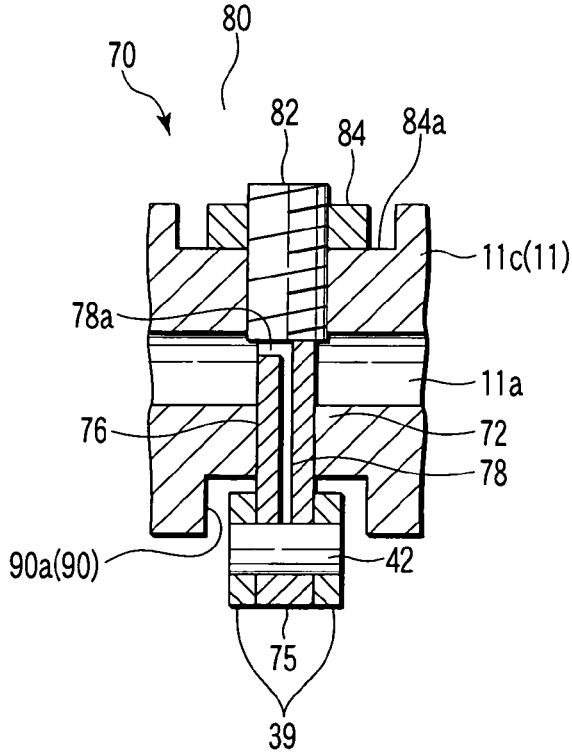
FIG. 12B is a sectional side view, partially in section, showing the principal parts of the variable valve train apparatus according to the second embodiment of the present invention and the structure of the adjustment portion for adjusting dispersion of the variable valve train apparatus.

A variable valve train apparatus for an internal combustion engine according to a second embodiment of the present invention will now be described with reference to FIGS. 12A and 12B. FIGS. 12A and 12B show principal parts of the second embodiment of the present invention.

In the present embodiment, a recess 90 is formed in a rocker shaft 11 or a control shaft according to the present invention, and a part of a junction portion 79 between a center rocker arm 35 and a control arm 72 that are connected by a pin 42 is housed in the recess 90.

More specifically, according to the present invention, a notch portion 90*a* that defines the recess 90 is formed in the lower part of the rocker shaft 11 or that part of the outer peripheral surface of the rocker shaft 11 on which the pin 42 is located, as shown in FIGS. 12A and 12B. A part of a junction portion 79, including a part of the pin 42, for example, is housed in the notch portion 90*a*.

With use of this housing structure, as shown in FIG. 12A, an interaxial distance L from the axis of the pin 42 that connects the center rocker arm 35 and the control arm 72 to the axis of the control shaft can be shortened. Thus, an adjustment portion 80 can be compactified.

Further, the overall length of the control arm 72 can be shortened, and the adjustment portion 80 can be reduced in weight. Since the interaxial distance L is shortened, moreover, a variation of the cam phase for each unit revolution of the rocker shaft 11 or the control shaft becomes smaller. Correspondingly, therefore, the opening/closing timing and the lift can be controlled with higher accuracy. Further, a load with which the center rocker arm 35 is moved, that is, the rotational torque of the rocker shaft 11, can also be lessened. There is an additional advantage that a reaction force or rotational torque from an intake valve 5 can also be lessened.

Figure 13A:
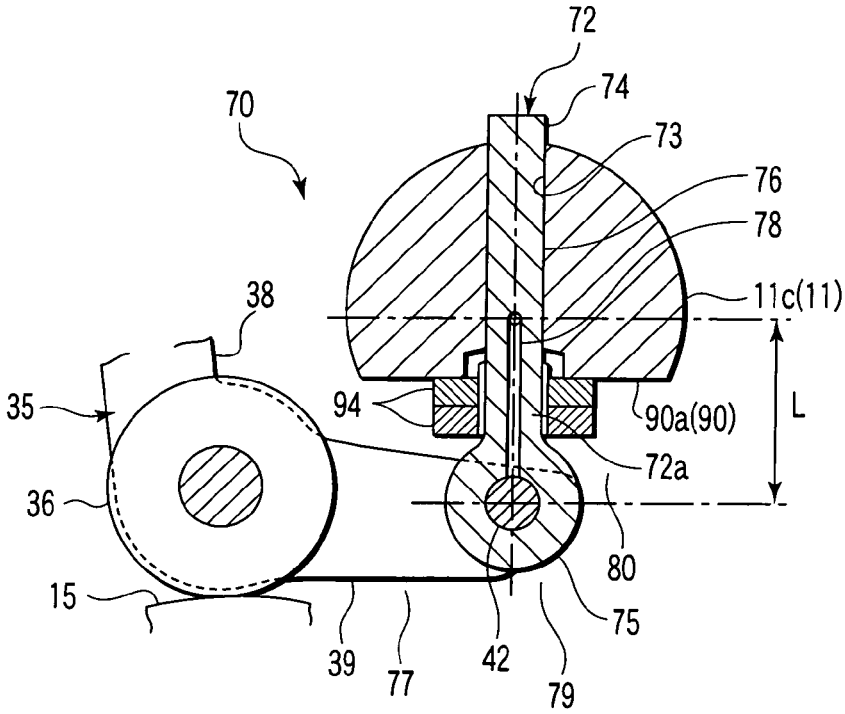
FIG. 13A is a front view, partially in section, showing principal parts of a variable valve train apparatus according to a third embodiment of the present invention and the structure of an adjustment portion for adjusting dispersion of the variable valve train apparatus.
Figure 13B:
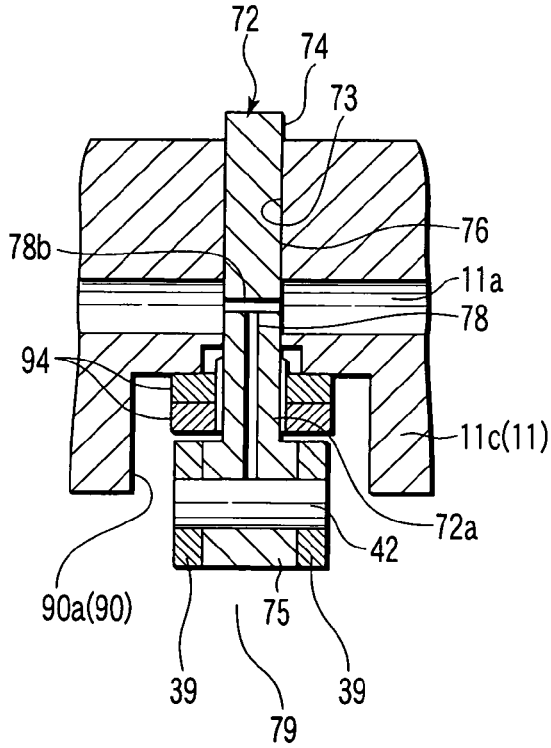
FIG. 13B is a sectional side view, partially in section, showing the principal parts of the variable valve train apparatus according to the third embodiment of the present invention and the structure of the adjustment portion for adjusting dispersion of the variable valve train apparatus.

A variable valve train apparatus for an internal combustion engine according to a third embodiment of the present invention will now be described with reference to FIGS. 13A and 13B. FIGS. 13A and 13B show principal parts of the third embodiment of the present invention.

In the present embodiment, as shown in FIGS. 13A and 13B, the structure that uses the screw member 82 according to the first or second embodiment is replaced with a structure in which nut members 94 for use as an adjustment portion 80 are threadedly fitted for advance and retreat on an arm portion 72*a* of a control arm 72 between a rocker shaft 11 or a control shaft and a junction portion 79 that is connected by a pin 42, whereby the amount of projection of the control arm 72 from the rocker shaft 11 can be adjusted.

Specifically, the structure of the adjustment portion 80 is a combination of a structure such that an adjustment area portion 76 of the control arm 72 is inserted into a through hole 73, which is formed diametrically penetrating the rocker shaft 11, from below the through hole 73 and a structure such that the nut members 94 are movably fitted on the bottom portion of a pin connecting piece 75 or the arm portion 72*a* that projects from the rocker shaft 11, whereby the control arm 72 is butted against the rocker shaft 11 to be supported thereby.

When the nut members 94 of the adjustment portion 80 constructed in this manner are rotated, the entire control arm 72 is displaced in the axial direction, whereupon the amount of projection of the adjustment area portion 76 or the control arm 72 from a shaft portion 11*c* is changed or adjusted.

Thus, the same effect of the foregoing first embodiment can also be obtained with this arrangement. Naturally, the adjustment portion 80 is structurally simple and can be assembled to the rocker shaft 11 by only inserting the control arm 72 fitted with the nut members 94 into the rocker shaft 11, so that its assembly is also simple.

In another structure used in the present embodiment, as shown in FIGS. 13A and 13B, a recess 90 is formed in a part of the outer peripheral surface of the lower part of the rocker shaft 11, that is, on the side of the rocker shaft 11 where the pin 42 is located, and a part of the junction portion 79 is housed in the recess 90, as described in connection with the second embodiment. Thus, an interaxial distance L from the pin 42 that connects the center rocker arm 35 and the control arm 72 to the rocker shaft 11 or the control shaft is shortened, so that the same effect of the second embodiment can also be obtained.

In the present embodiment, a T-shaped end portion is used at an inlet of a lubricant passage 78 of the control arm 72, opening into a passage 11*a* of the rocker shaft 11 in the middle of the control arm 72. In FIG. 13B, number 78*b* denotes the T-shaped portion.

Figure 14A:
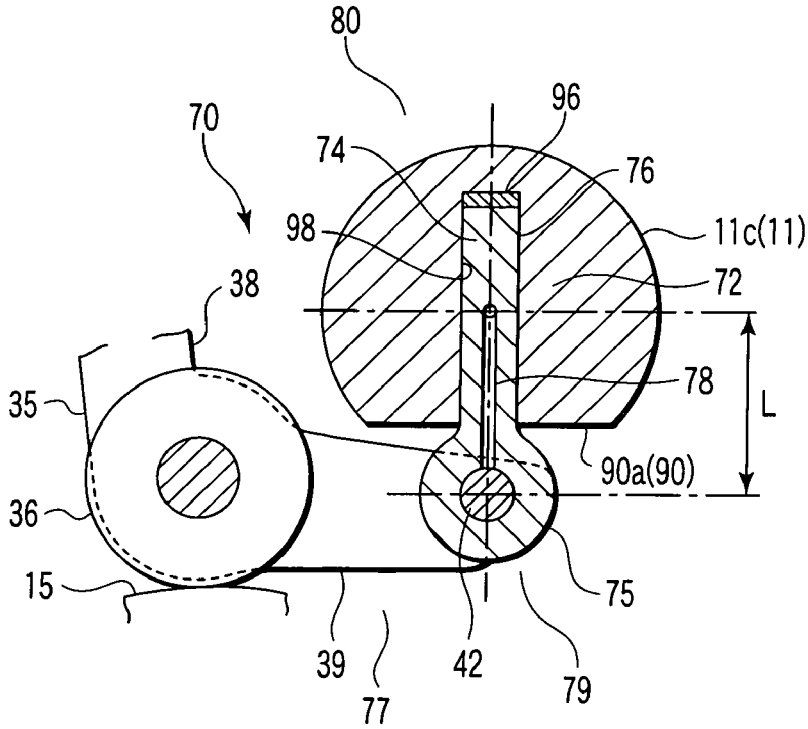
FIG. 14A is a front view, partially in section, showing principal parts of a variable valve train apparatus according to a fourth embodiment of the present invention and the structure of an adjustment portion for adjusting dispersion of the variable valve train apparatus.
Figure 14B:
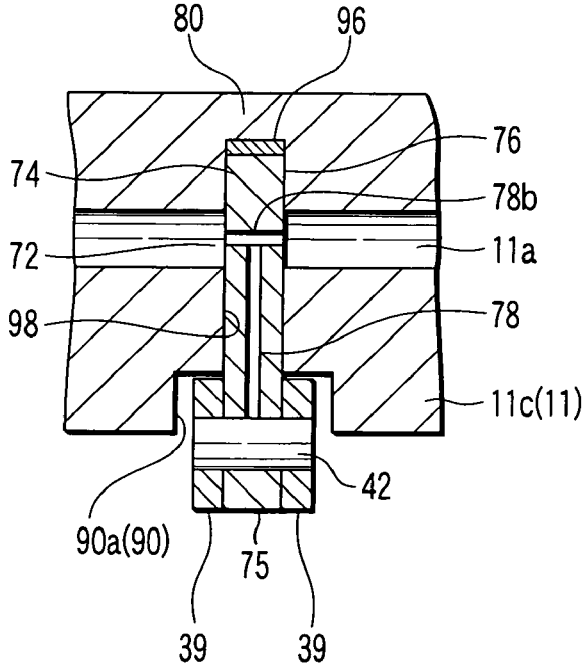
FIG. 14B is a sectional side view, partially in section, showing the principal parts of the variable valve train apparatus according to the fourth embodiment of the present invention and the structure of the adjustment portion for adjusting dispersion of the variable valve train apparatus.

A variable valve train apparatus for an internal combustion engine according to a fourth embodiment of the present invention will now be described with reference to FIGS. 14A and 14B. FIGS. 14A and 14B show principal parts of the fourth embodiment of the present invention.

In the present embodiment, a shim 96, a spacer, is interposed as an adjustment portion 80 between the distal end of a adjustment area portion 76 or the other end of a control arm 72 and a rocker shaft 11, in place of the structure that uses the screw member and the nut members according to each of the first to third embodiments. The amount of projection of the control arm 72 from the rocker shaft 11 can be adjusted by means of the shim 96.

Specifically, the structure of the adjustment portion 80 is a combination of a structure such that an adjustment area portion 76 of the control arm 72 is inserted into a bottomed hole 98, which is formed diametrically extending in the rocker shaft 11, from below the hole 98 and a structure such that the shim 96 is interposed between the insertion end of the adjustment area portion 76 and the bottom surface of the hole 98.

In the adjustment portion 80 constructed in this manner, the amount of projection of the adjustment area portion 76 or the control arm 72 from the shaft portion 11*c* can be varied by interposing a shim 96 with a different thickness or a plurality of shims 96 between the insertion end of the adjustment area portion 76 and the bottom surface of the hole 98, for example.

Thus, the same effect of the foregoing first embodiment can also be obtained with this arrangement. Naturally, the adjustment portion 80 is structurally simple.

Also in another structure used in the present embodiment, a recess 90 is formed in a part of the outer peripheral surface of the lower part of the rocker shaft 11, that is, on the side of the rocker shaft 11 where a pin 42 is located, and a part of a junction portion 79 is housed in the recess 90, as described in connection with the second embodiment. Thus, an interaxial distance L from the pin 42 to the rocker shaft 11 or the control shaft is shortened.

The same portions of the second to fourth embodiment as those of the first embodiment are designated by like numbers, and a description thereof is omitted.

The present invention is not limited to the embodiments described above, and various modifications may be made without departing from the spirit of the present invention. Although the intake-side rocker shaft is used also as the control shaft in the structure adopted in any of the foregoing embodiments, a control shaft may be used separately in an alternative structure.

Although the present invention is applied to the intake valve side according to the foregoing embodiments, moreover, the present invention may alternatively be applied to the exhaust valve side. In the foregoing embodiments, furthermore, the present invention is applied to the engine provided with the SOHC-type valve train system that drives the intake valve and the exhaust valve by means of the single camshaft. Alternatively, however, the present invention may be applied to an engine provided with a valve train system of the double overhead camshaft (DOHC) type having a structure such that camshafts are dedicated to the intake side and the exhaust side, individually.

INDUSTRIAL APPLICABILITY

According to the present invention, dispersion between cylinders and the like can be adjusted with high accuracy by means of a structure for adjusting the distance between the axis of a control shaft and the axis of rotation of a transmission arm. In consequence, generation of vibration in an internal combustion engine and lowering of the fuel efficiency attributable to dispersion can be prevented.

Besides, a control arm and the transmission arm are connected for rocking motion around an axis in substantially the same direction as the axial direction of the control shaft, so that a variable range for the control arm is transmitted directly to the transmission shaft. Thus, the adjustment can be performed covering a wide-range region.

The invention claimed is:

1. A variable valve train apparatus for an internal combustion engine, characterized by comprising:

a camshaft provided for rotation in the internal combustion engine;

a cam formed on the camshaft;

a rocking cam which is provided for rocking motion in the internal combustion engine and driven by the cam;

an intake valve or an exhaust valve which is driven by the rocking cam;

a control shaft provided for rotation and side by side with the camshaft in the internal combustion engine;

a control arm having one end held on the control shaft and the other end projecting from the control shaft;

an actuator which rotates the control shaft to displace the control arm;

a transmission arm which is connected to the other end of the control arm for rocking motion around a rocking axis in substantially the same direction as an axial direction of the control shaft and transmits a displacement of the control arm to the rocking cam; and an adjustment mechanism which adjusts a distance between an axis of the control shaft and the rocking axis of the transmission arm.

2. A variable valve train apparatus for an internal combustion engine according to claim 1, characterized in that the control arm is held on the control shaft for rocking motion around an axis in a direction perpendicular to the axial direction of the control shaft.

3. A variable valve train apparatus for an internal combustion engine according to claim 1 or 2, characterized in that the one end of the control arm is inserted into the control shaft, and the adjustment mechanism is constructed including an adjustment screw member which is threadedly inserted for advance and retreat in the control shaft on the side opposite from the control arm and engages the one end of the control arm.

4. A variable valve train apparatus for an internal combustion engine according to claim 1 or 2, characterized in that the adjustment mechanism is constructed including a nut member threadedly fitted for advance and retreat on an arm portion between the control shaft and the other end of the control arm.

5. A variable valve train apparatus for an internal combustion engine according to claim 1, characterized in that the adjustment mechanism is constructed including a spacer interposed between the one end of the control arm and the control shaft.

6. A variable valve train apparatus for an internal combustion engine according to claim 1, characterized in that the control shaft is formed with a recess in which a part of a junction portion connecting the transmission arm and the control arm is housed.

7. A variable valve train apparatus for an internal combustion engine according to claim 2, characterized in that the control shaft is formed with a recess in which a part of a junction portion connecting the transmission arm and the control arm is housed.

8. A variable valve train apparatus for an internal combustion engine according to claim 5, characterized in that the control shaft is formed with a recess in which a part of a junction portion connecting the transmission arm and the control arm is housed.

* * * * *